US007815271B2

(12) United States Patent
Ando et al.

(10) Patent No.: US 7,815,271 B2
(45) Date of Patent: Oct. 19, 2010

(54) RECORDING MEDIUM DRIVING DEVICE AND RECORDING MEDIUM DRIVING METHOD

(75) Inventors: Makoto Ando, Tokyo (JP); Takahiro Toyoda, Tokyo (JP); Tatsumi Ito, Tokyo (JP); Minoru Takeda, Tokyo (JP); Koji Ashizaki, Tokyo (JP); Seiji Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 642 days.

(21) Appl. No.: 11/685,310

(22) Filed: Mar. 13, 2007

(65) Prior Publication Data

US 2007/0222844 A1 Sep. 27, 2007

(30) Foreign Application Priority Data

Mar. 24, 2006 (JP) ..... 2006-082415

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS

2004/0141045 A1* 7/2004 Hanks ..... 347/215
2005/0206661 A1* 9/2005 Lugaresi et al. ..... 346/131
2006/0126474 A1* 6/2006 Hanks ..... 369/59.1

FOREIGN PATENT DOCUMENTS

| | | |
|---|---|---|
| JP | 5-238005 | 9/1993 |
| JP | 9-265760 | 10/1997 |
| JP | 2001-291235 | 10/2001 |
| JP | 2002-531290 | 9/2002 |
| JP | 2003-326694 | 11/2003 |
| JP | 2004-110994 | 4/2004 |
| WO | WO 00/32399 | 6/2000 |

* cited by examiner

*Primary Examiner*—Matthew Luu
*Assistant Examiner*—Justin Seo
(74) *Attorney, Agent, or Firm*—Oblon, Spivak, McClelland, Maier & Neustadt, L.L.P.

(57) ABSTRACT

A recording medium driving device includes a recording and/or playback unit for performing at least one of recording of a data signal on the recoding surface of a recording medium, and playback of a data signal from the recording surface, a printing unit for printing visible information on the main surface different from the recording surface of the recording medium using an inkjet method, a driver for performing driving as to the recording medium, and a drive control unit for switching the driving speed of the driver by a printing mode for printing visible information on the main surface or a recording/playback mode for recording or playback of the data signal on/from the recording surface.

12 Claims, 13 Drawing Sheets

FIG. 13

| PROGRAM NAME | CHANNEL | BROADCASTING DATE | MAIN GENRE | SUB GENRE | PERFORMER |
|---|---|---|---|---|---|
| MAN IN BLACK | 7 | JAN. 31, 2006<br>20:00 TO 22:00 | MOVIE | ACTION | JOHN SMITH |
| NIGHT TRAIN | 7 | JAN. 31, 2006<br>22:00 TO 23:00 | DRAMA | MYSTERY | TARO SHINAGAWA |
| ⋮ | ⋮ | ⋮ | ⋮ | ⋮ | ⋮ |

RECORDING MEDIUM DRIVING DEVICE AND RECORDING MEDIUM DRIVING METHOD

CROSS REFERENCES TO RELATED APPLICATIONS

The present invention contains subject matter related to Japanese Patent Application JP 2006-082415 filed in the Japanese Patent Office on Mar. 24, 2006, the entire contents of which are incorporated herein by reference.

BACKGROUND OF THE INVENTION

1. Field of the Invention

The present invention relates to a recording medium driving device and a recording medium driving method, whereby visible information is printed on the label surface of a recording medium.

2. Description of the Related Art

In recent years, optical discs serving as optical recording media have been widely rapidly spread as media for recording video and audio using a digital format. Particularly, information (visible information) relating to the contents recorded on an optical disc can be displayed on the disc surface, whereby an optical disc including a printable printing surface (main surface) which can be printed with an inkjet printer has attracted attention.

Heretofore, an arrangement has been made wherein following recording a data signal such as video, audio, and so forth on an optical disc using a recording device, a user replaces the optical disc of a dedicated printer with the recorded optical disc, and prints visible information created upon a PC (Personal Computer) on the optical disc. However, it has been complicated to print the visible information using the PC and the dedicated printer each time a movie, sport relay broadcast, or the like is recorded on an optical disc.

On the other hand, Japanese Unexamined Patent Application Publication No. 2004-110994 has disclosed a device for reducing the time and effort of a user by printing visible information simultaneously at the time of recording a data signal such as video, audio, and so forth on an optical disc.

SUMMARY OF THE INVENTION

However, there has been a problem wherein upon simultaneously performing recording of a data signal and printing of visible information on an optical disc, it is difficult to obtain excellent printing quality. Specifically, it is necessary to rotate the optical disc at high speed at the time of recording a data signal, and upon ink landing upon the optical disc rotating at high speed, the ink shifts in response to the influence of centrifugal force after landing in some cases. Also, there has been a problem wherein there are irregularities regarding the flight speed of the ink, so the higher the optical disc rotates, the more the landing position of the ink is shifted in the circumferential direction of the optical disc.

It has been found desirable to provide a recording medium driving device and a recording medium driving method, which are new and improved, so as to suppress the deviations of the landing position of ink and after landing and obtain excellent printing quality at the time of printing visible information on a recording medium using an inkjet printer.

According to an embodiment of the present invention, there is provided a recording medium driving device including a recording and/or playback unit for performing at least one of recording of a data signal on the recording surface of a recording medium, and playback of a data signal from the recording surface, a printing unit for printing visible information on the main surface different from the recording surface of the recording medium using an inkjet method, a driver for performing driving as to the recording medium, and a drive control unit for switching the driving speed of the driver by a printing mode for printing visible information on the main surface or a recording/playback mode for recording or playback of the data signal on/from the recording surface.

According to such a configuration, driving of a driver and a recording medium interlocked with the driver is controlled by the drive control unit. The drive control unit can switch the driving speed of the recording medium at the time of recording a data signal and at the time of printing visible information (label information), whereby recording of a data signal and printing of visible information can be performed under the most appropriate driving speed of the recording medium respectively.

The driving speed in the printing mode can be delayed as compared with the driving speed in the recording/playback mode. According to such a configuration, the driving speed at the time of printing is delayed, whereby the centrifugal force produced in the ink following ink landing on the recording medium, can be suppressed. Also, the printing unit is provided with multiple nozzles, and even if there are irregularities in speed discharging ink depending on the respective nozzles, the error of the landing position of ink due to such irregularities can be cancelled out.

The printing unit may adjust a printing position based on the positional information of a recording medium read out from a reference signal recorded on the recording surface of the recording medium. According to such a configuration, detecting the positional information indicating the absolute position in an arbitrary point on the recording medium enables printing of visible information while correcting a printing position as appropriate. Also, the print region of the printed visible information can be recognized accurately, so recording the print region thereof in a predetermined region of the recording surface of the recording medium or in an external storage device enables new visible information to be printed on an unprinted region later.

The reference signal may be recorded on the circumference in one or multiple predetermined radius distance of the recording medium. According to such a configuration, the recording and/or playback unit can detect the reference signal steadily. Also, recording the multiple reference signals enables another reference signal to be read and reflected on printing of visible information even in the event that one of the reference signals fails in reading under the influence of a crack or dirt.

The printing unit may adjust the number of times of ink discharge per unit time depending on the radius distance from the center of the recording medium of the printing position of the visible information. According to such a configuration, the printing density difference in the inner and outer circumference of an optical disc produced when visible information is printed to the optical disc serving as a recording media under a fixed rotation (drive) speed is cancelable. That is to say, the length of the circumference is proportional to radius distance, so the interval (dot spacing) where ink lands is also proportional to the radius distance. Accordingly, with the inner circumferential portion, the dot spacing is narrowed, and printing density increases, so for example, the printing unit thins out ink to be discharged at the time of printing the inner circumferential portion, whereby visible information can be printed with even printing density over the inner and outer circumferential portion whole region.

Also, according to another embodiment of the present invention, there is provided a recording medium driving method employing a recording medium device including a recording and/or playback unit for performing at least one of recording of a data signal on the recording surface of a recording medium, and playback of a data signal from the recording surface, and a printing unit for printing visible information on the main surface different from the recording surface of the recording medium using an inkjet method, for printing the visible information, which switches the driving speed of a driver for driving the recording medium by a printing mode for printing visible information on the main surface or a recording/playback mode for recording or playback of the data signal on/from the recording surface. According to such a configuration, delaying the driving speed at the time of printing enables centrifugal force produced in the ink following ink landing on the recording medium to be suppressed. Also, the printing unit is provided with multiple nozzles, and even if there are irregularities in speed discharging ink depending on the respective nozzles, the error of the landing position of ink due to such irregularities can be cancelled out.

According to the present invention as described above, when printing visible information on a recording medium using an inkjet printer, the deviations of the landing positions of ink and after landing can be suppressed, and excellent printing quality can be obtained.

BRIEF DESCRIPTION OF THE DRAWINGS

FIG. 13 is an explanatory diagram illustrating the contents of electronic program data.

DESCRIPTION OF THE PREFERRED EMBODIMENTS

Figure 1:
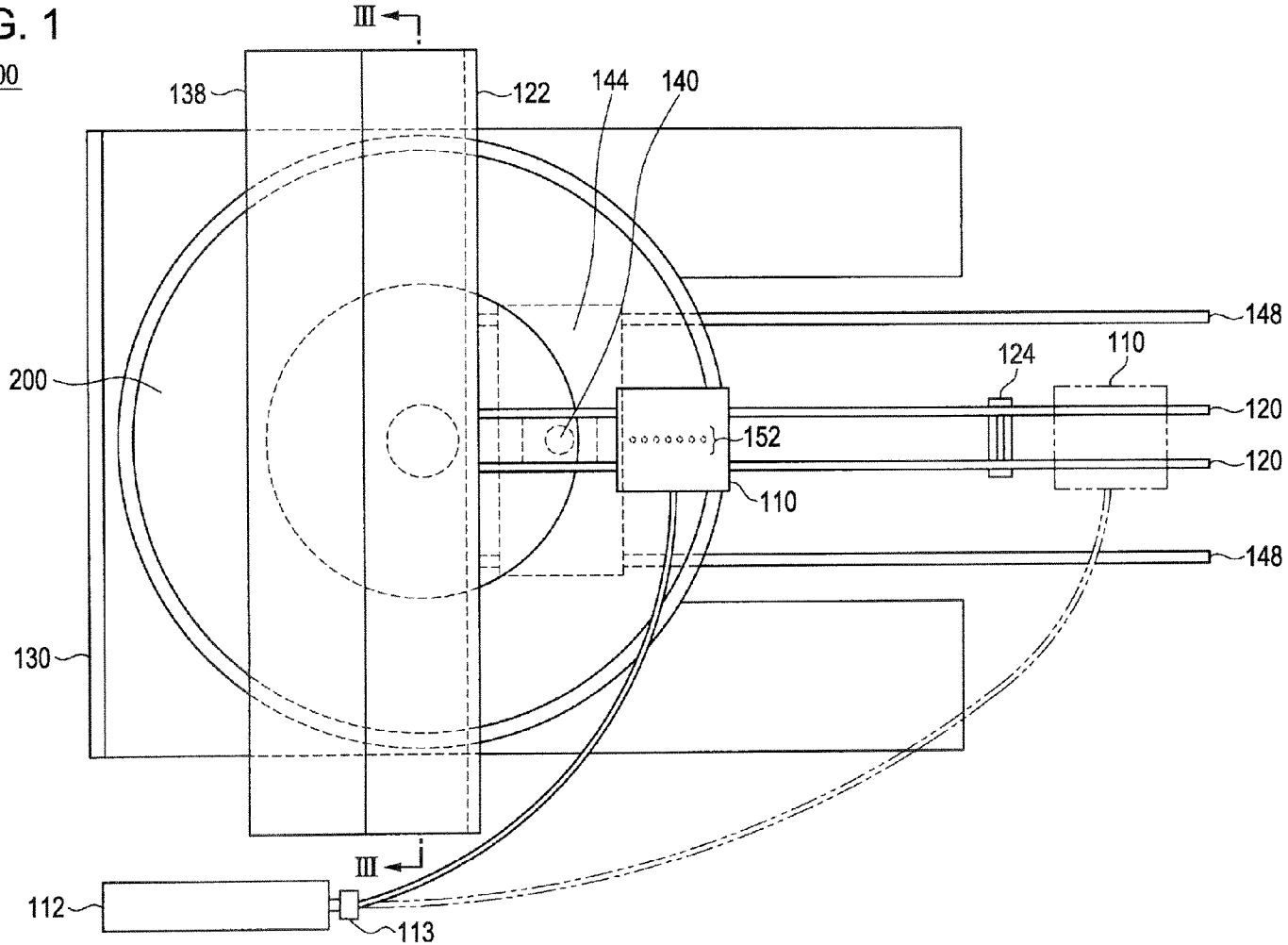
FIG. 1 is a plan view illustrating the schematic appearance of an optical disc device according to the present embodiment.

Preferred embodiments of the present invention will now be described in detail with reference to the attached drawings. Note that with regard to the present Specification and the drawings, components which have essentially the same functional configuration will be denoted with the same reference numerals, and redundant description thereof will be omitted.

First Embodiment

First, description will be made regarding the configuration of an optical disc device according to a first embodiment of the present invention with reference to FIGS. 1 through 4.

Figure 2:
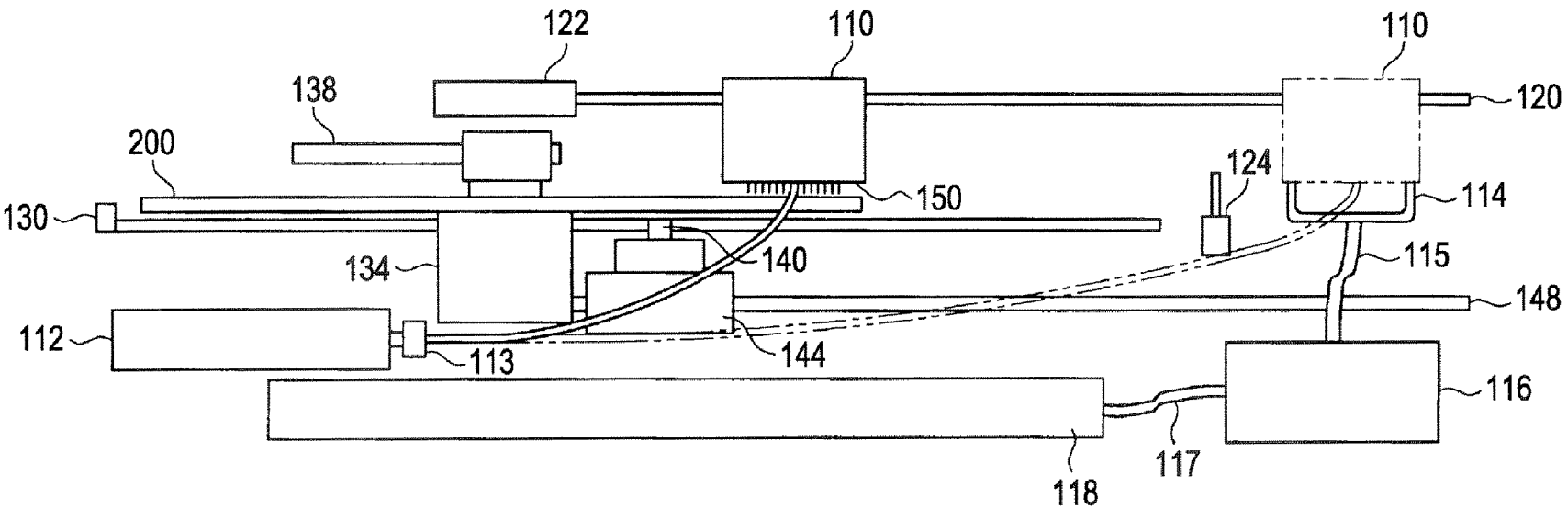
FIG. 2 is a side view illustrating the schematic appearance of the optical disc device according to the present embodiment.

FIG. 1 is a plan view illustrating the schematic appearance of an optical disc device according to the present embodiment. FIG. 2 is a side view illustrating the schematic appearance of the optical disc device according to the present embodiment. Note that the example shown in the drawings illustrates a state in which an optical disc is mounted on the optical disc device.

An optical disc device 100 includes a printing unit for printing label information serving as visible information such as characters or an image or the like on the label surface (main surface) of an optical disc 200 serving as a recording medium, and a recording and/or playback unit for recording a data signal on the recording surface of the optical disc 200, or playing a data signal from the recording surface of the optical disc 200, and serves as a recording medium driving device.

The printing unit includes a print head 110, an ink cartridge 112, a head cap 114, a suction pump 116, a waste ink absorber 118, a first guide shaft 120, a shaft supporting portion 122, and a blade 124.

The print head 110 includes a nozzle line 152 for discharging ink as to a nozzle surface 150 facing the optical disc 200, and discharges ink with an ink discharge frequency of 8.4 KHz for example from that nozzle using an inkjet method. Note that the inkjet method means a method for discharging ink from the nozzle line 152 as fine drops to be adhered to a sheet.

Also, the print head 110 evacuates to the outside of the optical disc 200 at the time of printing standby, and is disposed above the optical disc 200 at the time of printing. Additionally, the print head 110 includes a function for performing dummy discharge of ink before and after printing to discharge thickening ink, air bubbles, foreign substance, etc., from a nozzle.

The ink cartridge 112 contains ink of a predetermined color, and supplies the ink to the print head 110. Further in detail, the ink cartridge 112 is a container made up of a cylindrical resin, and has built in a porous member such as sponge or ceramic. Ink is stored by the capillary force of the porous body. The ink cartridge 112 supplies the ink to the print head 110 via a connection portion 113. Such an ink cartridge 112 is detachable at the connection portion 113, so in the event of running out of ink, the ink cartridge 112 can be readily replaced.

The head cap 114 is mounted on the nozzle surface 150 of the print head 110 at the time of printing standby, and prevents drying out of the ink which the print head 110 contains, and also prevents foreign substances, such as dirt and dust, from adhering to the nozzle surface 150. On the other hand, at the time of printing, the head cap 114 is detached from the print head 110. Also, the head cap 114 includes a porous layer, and has a function for temporarily holding the ink dummy-discharged by the print head 110. Note that at the time of dummy discharge, there is provided a valve mechanism (not shown) which can be adjusted such that the air pressure at the inner space of the head cap 114 becomes the same as atmospheric pressure.

The suction pump 116 is connected to the head cap 114 via a tube 115, and when the head cap 114 is mounted on the print head 110, negative pressure is applied to the inner space of the head cap 114, whereby the ink within the print head 110 can be absorbed. Also, the ink temporarily held by the head cap 114, which was dummy-discharged by the print head 110, can be also absorbed.

The waste ink absorber 118 is connected to the suction pump 116 via a tube 117, from which the ink absorbed by the suction pump 116 is discarded.

The first guide shaft 120 moves the print head 110 in the radial direction of the optical disc 200. As for this movement, the first guide shaft 120 can move the print head 110 using not only a ball screw delivery mechanism but also using a rack-and-pinion mechanism, a belt delivery mechanism, a wire delivery mechanism, or the like. The shaft supporting portion 122 supports one end of the first guide shaft 120.

The blade 124 is disposed between the printing standby position and the printing position of the print head 110, wipes the nozzle surface 150 of the print head 110 to remove the foreign substances, ink, or the like adhered to the nozzle surface 150 when the print head 110 moves from the printing standby position to the printing position, or when the print head 110 moves from the printing position to the printing standby position. Note that moving the blade 124 up and down enables selection regarding whether or not to wipe the nozzle surface 150.

Also, the recording and/or playback unit includes a tray 130, a spindle motor 134, a chucking unit 138, an optical pickup 140, a movable carriage 144, and a second guide shaft 148.

The tray 130 has a shape on which is mounted the optical disc 200, and is moved to right and left in FIG. 2, whereby the optical disc 200 can be mounted or detached.

The spindle motor 134 rotates based on a control signal input from a motor driving circuit (not shown), and serves as a driver for driving the optical disc 200 collaborating with the motor driving circuit. Detailed description will be made later regarding the rotational speed of the spindle motor 134 and the motor driving circuit.

The chucking unit 138 is in contact with the upper portion of the spindle motor 134. The optical disc 200 mounted on the tray 130 rotates interlocked with the rotation of the spindle motor 134, and emerges from the tray 130. The chucking unit 138 includes a function for preventing the optical disc 200 from emerging and detachment from the tray 130.

The optical pickup 140 is an optical system module including a light source, a beam splitter for deflecting the laser beam which entered from the light source, an irradiation unit for irradiating the laser beam which is polarized to the optical disc 200, and a detecting unit for detecting the reflected light from the optical disc 200.

The movable carriage 144 on which the optical pickup 140 can be mounted can be moved in the radial direction of the optical disc 200 by the second guide shaft 148.

Next, the configuration of the optical disc 200 will be described with reference to FIG. 3.

Figure 3:
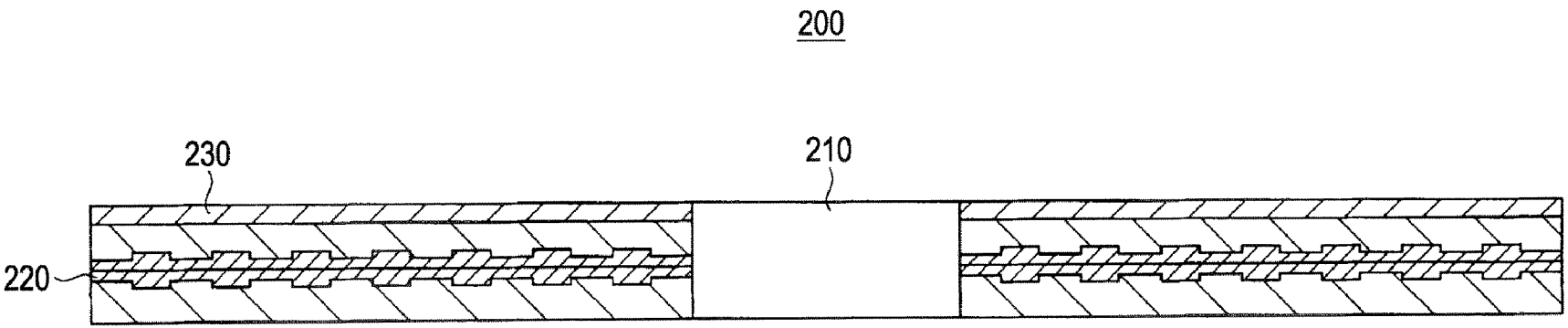
FIG. 3 is an explanatory diagram illustrating the schematic cross section taken along line III-III in FIG. 1 of the optical disc.

FIG. 3 is an explanatory diagram illustrating the schematic cross section taken along line III-III in FIG. 1 of the optical disc 200. The optical disc 200 includes a center hole 210, a recoding surface 220, and a label surface 230.

The center hole 210 is a circular hole for fitting the optical disc 200 in the spindle motor 134 and the chucking unit 138. The diameter of the center hole 210 may be 15 mm through 16 mm or so.

The recording surface 220 includes a data signal recording region for recording various types of information, and a reference signal recording region for detecting the rotation angle of the optical disc 200. For example, with DVD-R, the data signal recording region can be formed with a spiral land groove structure; detailed description thereof will be made later with reference to FIGS. 5A and 5B along with the reference signal recording region.

The label surface 230 serves as a receiving layer (visible information print layer) of ink in ink jet printing, on which label information such as characters, symbols, a photo, and the like can be printed. The printable range of the label surface 230 may be a region with a 37-mm width and a 20-mm through 57-mm radius of the optical disc 200. Note that the label surface 230 can be configured of sticking printing paper on the whole surface of the optical disc 200 additionally.

Note that the recording medium is not restricted to the optical disc 200, and may be a recording medium such as a magnetic disk, a magneto-optic disk, electrically rewritable flash memory, or the like. Also, a recording medium printing apparatus can be employed as a magnetic disk device or optical-magnetic disc device according to the kind of recording medium.

Next, description will be made regarding the flows of the printing unit and the recording and/or playback unit in the optical disc device according to the present embodiment.

Figure 4:
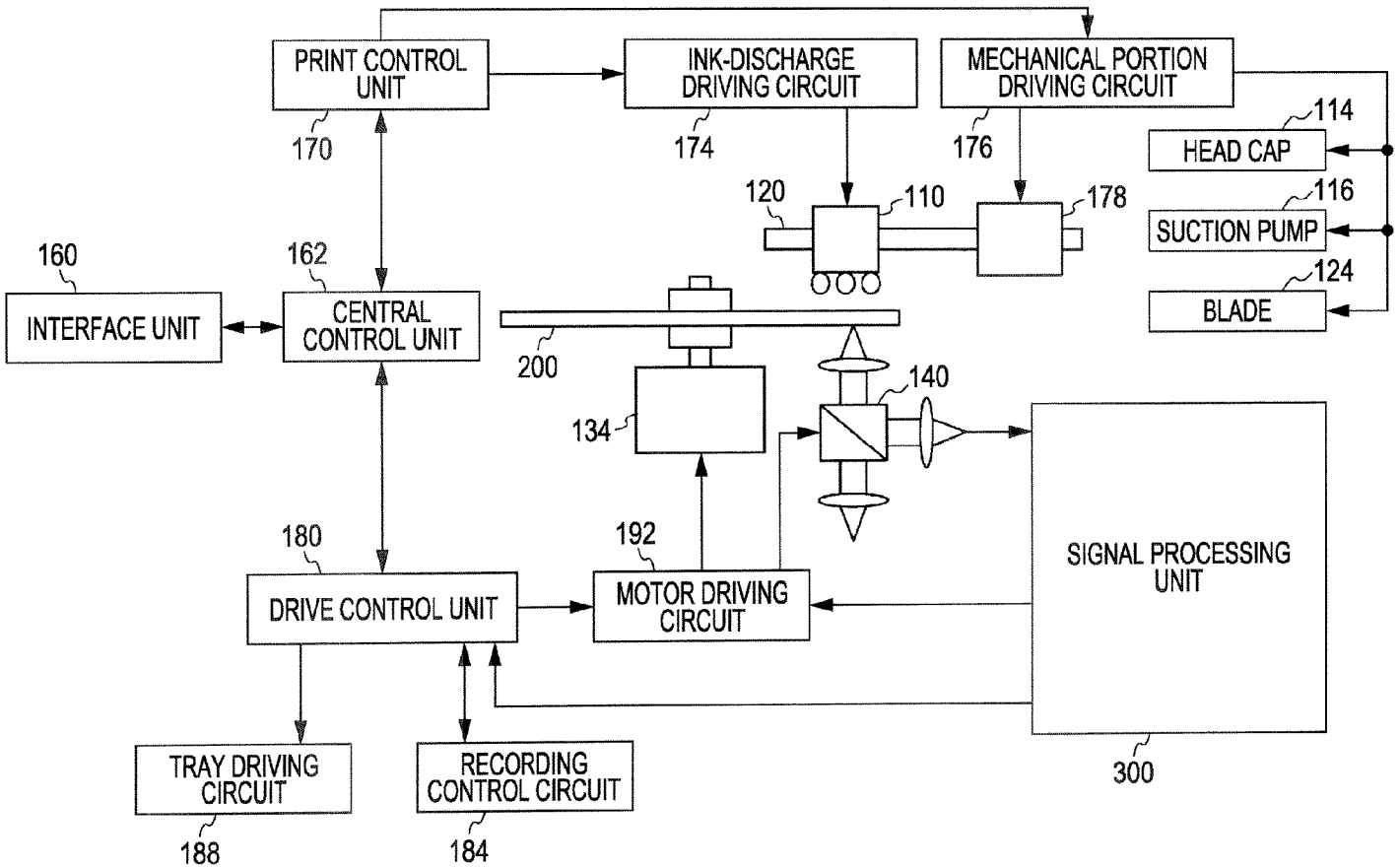
FIG. 4 is a block diagram illustrating the flows of signals of the optical disc device according to the present embodiment.

FIG. 4 is a block diagram illustrating the flows of signals of the optical disc device 100 according to the present embodiment. The optical disc device 100 includes an interface unit 160, a central control unit 162, a print control unit 170, an ink-discharge driving circuit 174, a mechanical portion driving circuit 176, a head driving motor 178, a driving control unit 180, a recording control circuit 184, a tray driving circuit 188, a motor driving circuit 192, and a signal processing unit 300.

The interface unit 160 is a connection portion with which the optical disc device 100 and an external device communicate a signal. The interface unit 160, upon a data signal to be recorded on the optical disc 200 or label information to be printed on the label surface being input externally, outputs these to the central control unit 162. Also, the interface unit 160 outputs the data signal that the optical disc device 100 plays from the optical disc 200 to the external device. Examples of the external device include a PC, a DVD recorder, or the like which exchanges a data signal and label information.

The central control unit 162 performs control of the optical disc device 100 in general. Specifically, the central control unit 162 subjects the label information input from the interface unit 160 to polar coordinates conversion to output this to the print control unit 170, outputs the data signal input from the interface unit 160 to the drive control unit 180, and controls the print control unit 170 and the drive control unit 180. Also, the central control unit 162 outputs reference information input from the drive control unit 180 to the print control unit 170.

The print control unit 170 outputs a signal for controlling printing of label information to the ink discharge driving circuit 104 and the mechanical portion driving circuit 176 based on input of the label information and reference information from the central control unit 162.

The ink-discharge driving circuit 174 drives the print head 110 to discharge ink to the mounted optical disc 200. For example, the ink-discharge driving circuit 174 is an electrode pair provided in the print head 110, and potential difference is generated between the electrode pair based on the signal input from the print control unit 170. Subsequently, the electrode pair is deformed, an ink tank (not shown) holding ink of the print head 110 is pressed, and the ink is discharged. Note that with the example in the drawing, ink is represented in a water droplet shape on the nozzle surface of the print head 110. Also, the ink-discharge driving circuit 174 may be configured employing a method for utilizing expansion of ink due to heat.

The mechanical portion driving circuit 176 drives the head cap 114, suction pump 116, blade 124, and head driving motor 178. The head driving motor 178 may be a motor for rotating the first shaft 120 to move the print head 110 in the radial direction of the optical disc 200.

Now, description will be made briefly regarding a division recording method, multi-pass recording method, and printing density correction method of label information controlled by the print control unit 170.

The division recording method means a method for printing label information shifting the phase of ink discharge each time the optical disc 200 rotates. For example, let us say that the phase of ink discharge is shifted by ¼ each time the optical disc 200 rotates, and the optical disc 200 rotates four times with the same radial distance. In this case, the interval of discharged ink (dot pitch) becomes the same interval in the case of printing using an ink discharge frequency quadruplicated, whereby printing of high-precision label information can be realized.

The multi-pass recording method is a method, as described in the above division recording method, for shifting the phase of ink discharge each time the optical disc 200 rotates, and also printing label information shifting the print head 110 in the radial direction of the optical disc 200. For example, let us say that 320 nozzles are arrayed with an interval of 0.0423 mm generally in the radial direction of the optical disc 200, and also the printable range of label information is a region of a 37-mm width of a 20-mm through 57-mm radius of the optical disc 200.

In this case, the phase of ink discharge is shifted by ¼ each time the optical disc 200 rotates, and simultaneously, printing is performed while moving the radial position in the optical disc 200 of the print head 110 by ¼ head (3.384 mm), and printing is completed when the optical disc 200 rotates 14 times in total. According to such a multi-pass recording method, the irregularities of the ink discharge amount for each nozzle are cancelled out, whereby improvement in printing quality can be realized.

The printing density correction method is a method for equalizing the dot pitch of ink in the whole print region of the optical disc 200. In the event that printing is performed by fixing the angular speed and ink discharge frequency of the optical disc 200, the dot pitch is proportional to the radial distance of the printing position, so a difference occurs in the inner and outer circumferences. For example, if we say that the printable range of label information is a region of a 37-mm width of a 20-mm through 57-mm radius of the optical disc 200, and also an ink discharge frequency is 8.4 kHz, the dot pitch at the position of the 57-mm radius of the outermost circumference is 0.0423 mm, but the dot pitch at the position of the 20-mm radius of the innermost circumference is 0.0148 mm.

That is to say, the dot pitch at the innermost circumference is around ⅓ of the dot pitch at the outermost circumference, so the amount of recording ink per unit area will increase 3 times, and printing density will become deep. The printing density correction method is a method for correcting and amending the label information to be printed beforehand regarding such a problem. Further in detail, this can be realized by thinning out the label information at the inner circumference of the optical disc 200 at the time of converting the label information input from the external device into the polar coordinates system. With the above example, the label information is processed such that the number of ink discharge at the innermost circumference becomes ⅓ of the number of ink discharge at the outermost circumference, whereby the printing density difference at the inner and outer circumferences can be eliminated.

Note that with the inner and outer circumferences of the optical disc 200, controlling the rotational speed of the optical disc 200 can also make printing density to some extent uniform. However, the print head 110 has a predetermined width, so the dot pitch differs depending on the radial distance of the optical disc 200 of each nozzle included in the print head 110, and printing density difference is caused in some cases.

The drive control unit 180 performs recording of a data signal on the optical disc 200 and playback control of a data signal from the optical disc 200, and switchover of rotational speed (driving speed) in a later-described printing mode and recording or playback mode.

The recording control circuit 184 performs encoding processing of a data signal such as a music signal, video signal or the like, modulation, and so forth. The tray driving circuit 188 drives the tray 130 on which the optical disc 200 is mounted.

The motor driving circuit 192 drives the spindle motor 134 and an optical pickup driving motor (not shown) based on the control by the drive control unit 180. The spindle motor 134 rotates the optical disc 200, and the optical pickup driving motor moves the position in the radial direction of the optical pickup 140. Description will be made below regarding the rotational speed (driving speed) of the optical disc 200 by the spindle motor 134.

The optical disc 200 usually rotates at 1000 rpm through several thousand rpm or so at the time of the recording or playback mode for performing recording or playback of a data signal. If we say that the rotational speed is 3000 rpm, circumferential speed is 19 m/s at the outermost circumference of the optical disc 200 of a 120-mm diameter. Also, the flight speed of ink discharge is usually 5 through 20 m/s or so. Here, the circumferential speed means speed wherein one arbitrary point on the optical disc 200 moves in the circumferential direction of the optical disc 200, and the flight speed means an average speed until ink discharged from a nozzle moves 1 mm or so from the nozzle.

Accordingly, in light of the unevenness of the landing positions of ink due to the air flow by the rotation of the optical disc 200, and irregularities of flight speed between the multiple nozzles, the rotation at the time of the printing mode for performing printing of the label information of the optical disc 200 may be 2 m/s or less at the circumferential speed or 320 rpm or less at the rotational speed. Even if the influence of centrifugal force to be received following ink landing on the optical disc 200 is considered, it is effective to set the rotation of the optical disc 200 to the above circumferential speed and rotational speed or so.

As another specific example, let us assume the case in which the flight speed of ink varies for each nozzle in a range of ±1 m/s centered on 10 m/s, and the distance between the print head 110 and the optical disc 200 is 1 mm. In this case, the flight time of ink is 111 μs at the maximum, and 91 μs at the minimum, and accordingly, the flight time of ink causes the difference of the maximum 20 μs between the nozzles. Accordingly, upon ink being discharged on the circumference whose circumferential speed is 19 m/s, the difference of the landing positions of ink is 384 μm at the maximum, and upon ink being discharged on the circumference whose circumferential speed is 2 m/s, the difference of the landing positions of ink is 40 μm at the maximum. The latter error is of a level hardly perceived with the naked eye, but the former is an error of the grade which can be recognized even with the naked eye, and is 9 times or more of the latter.

As described above, if the circumferential speed of the optical disc 200 is too fast, the error of the landing position of ink will become large, so with the present embodiment, recording of a data signal and printing of label information are performed with a separate rotational speed, for example, the rotational speed of the optical disc 200 in the printing mode may be 238 rpm (circumferential speed is 1.4 m/s at the outermost circumference).

The signal processing unit 300 subjects the RF (Radio Frequency) signal input from the optical pickup 140 to processing such as demodulation, error detection, correction, and the like, plays a data signal, and generates a tracking signal. Note that the optical pickup 140 is an optical system module including a light source, a beam splitter for deflecting the laser beam which entered from the light source, an irradiation unit for irradiating the laser beam which is polarized to the optical disc 200, and a detecting unit for detecting the reflected light from the optical disc 200.

Also, the signal processing unit 300 detects a reference signal indicating the rotation angle of the optical disc 200, and outputs this to the drive control unit 180. Description will be made below regarding the details of the signal processing unit 300 for detecting the above reference signal.

Usually, the rotation angle of a driving unit driven by a motor is detected by a rotary encoder or tachgenerator attached to the motor. However, with the optical disc device 100, the relative angle of the optical disc 200 as viewed from the spindle motor 134 varies each time the optical disc 200 is mounted or detached, so it is difficult for the above rotary encoder or tachgenerator to detect the absolute rotation angle of the optical disc 200.

It is important in respect of the following to detect the absolute rotation angle of the optical disc 200 at the time of printing label information. First, the rotation of the spindle motor 134 and the rotation of the optical disc 200 are not necessarily in agreement, so printing quality is not ensured by printing label information based on the rotation angle alone of the spindle motor 134. Second, when newly attempting to print label information later using the unprinted region of the optical disc 200 on which label information was printed once, a problem occurs wherein the optical disc device 100 fails to recognize regarding which region of the optical disc 200 is an unprinted region, and fails to add a postscript.

According to one embodiment of the present invention, there is provided the optical disc device 100 capable of detecting the absolute rotation angle information of the optical disc 200 based on the reference signal recorded on the optical disc 200 beforehand.

Figure 5A:
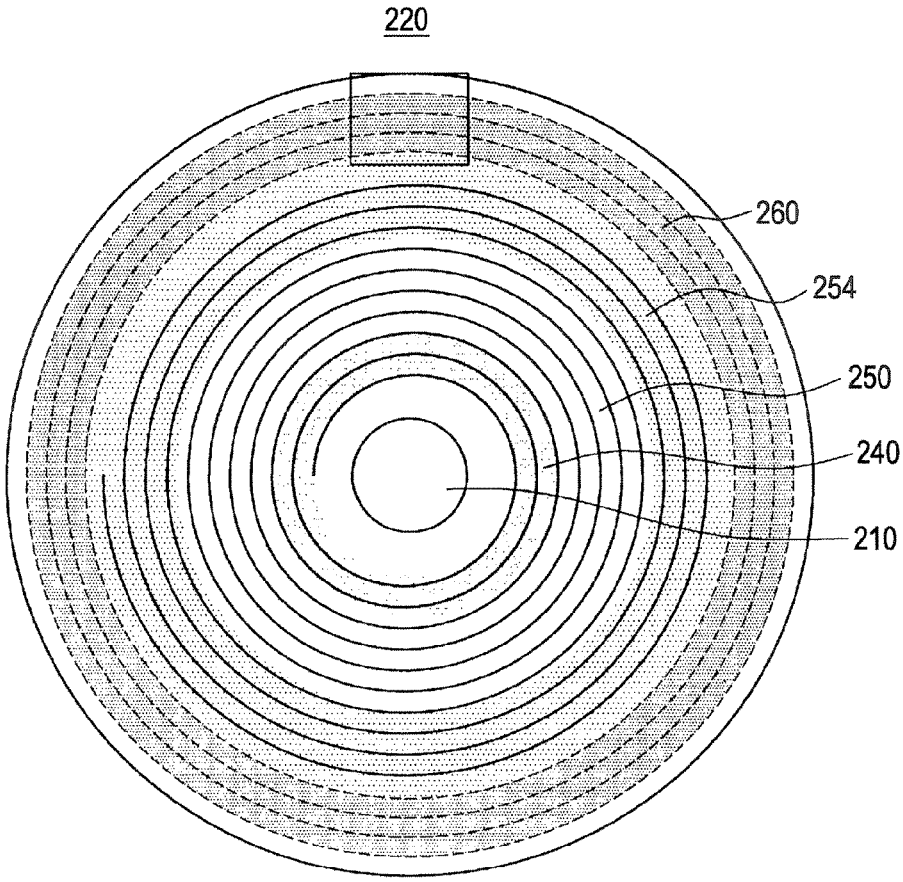
FIGS. 5A and 5B are explanatory diagrams illustrating the configuration of the recording surface of the optical disc.
Figure 5B:
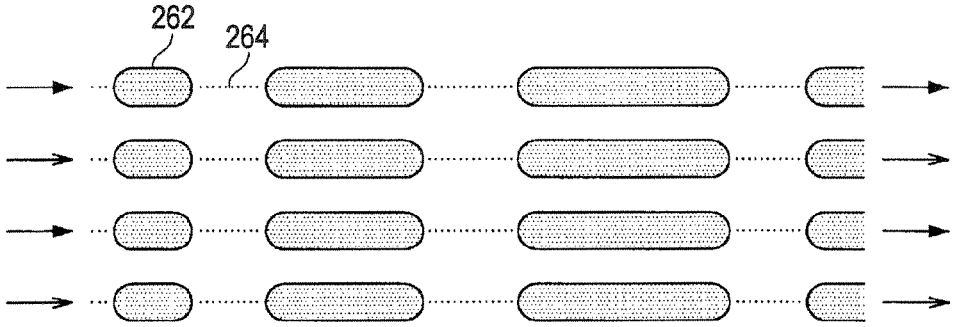

FIGS. 5A and 5B are explanatory diagrams illustrating the configuration of the recording surface of the optical disc 200. FIG. 5A is an explanatory diagram schematically representing the recording surface of the optical disc 200. The optical disc 200 includes the center hole 210, a read-in region 240, a data region 250, a readout region 254, and a reference signal recording region 260.

The read-in region 240 is located inside the data region 250, and shows the starting point of the data region 250. The readout region 254 is located outside the data region 250, and shows the end point of the data region 250. The data region 250 is located between the read-in region 240 and the readout region 254, wherein a data signal can be recorded. These three regions are, for example, made up of a spiral land groove structure, wherein disc information, sector information, and a clock signal are recorded using a groove wobble signal and a land prepit signal.

The reference signal recording region 260 is provided outside the readout region 254, wherein the reference signal indicating the rotation angle of the optical disc 200 can be recorded.

FIG. 5B is an explanatory diagram enlarging and illustrating a part of the reference signal recording region 260. The example shown in the drawing illustrates a state in which the reference signal is recorded using a pit signal.

The multiple reference signals can be recorded on the reference signal recording region 260 in a concentric circular shape by a pit 262 and a land 264. Note that the reference signals may be arranged so as to be recorded by a wobble signal and a land prepit signal in a land groove structure, or may be recorded in a spiral shape. Also, the reference signal recording region 260 may be included in the data region 250.

Figure 6:
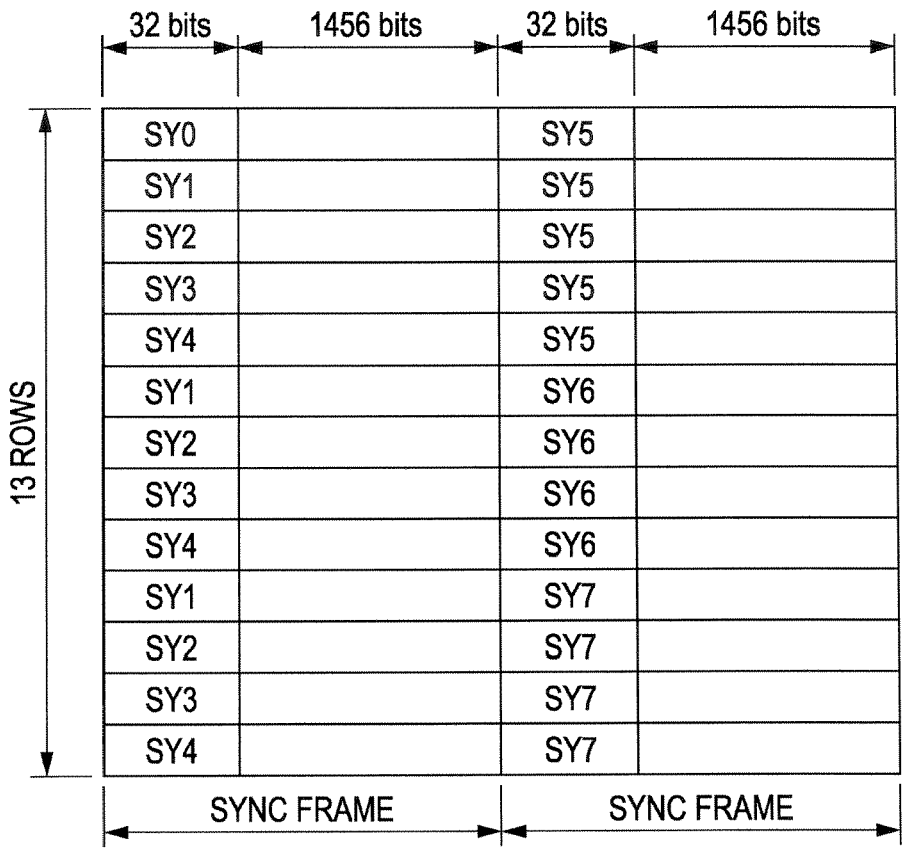
FIG. 6 is an explanatory diagram illustrating the specification of the physical sectors of DVD-ROM.

FIG. 6 is an explanatory diagram illustrating the specification of the physical sectors of DVD-ROM serving as one optical system recording medium. One synchronizing frame (Sync Frame) includes 1488 channel bits with synchronizing signals (SY0 through SY7) made up of 32 channel bits as the head thereof. One physical sector includes synchronizing frames of two lines and 13 rows, which is configured of 38688 channel bits, and the recording length of a pit is 5.10 through 5.21 mm or so.

Accordingly, in the event of providing the reference signal recording region 260 on the circumference of a 58.5-mm radius for example at the outermost portion of the optical disc 200, 71 physical sectors can be disposed on the same circumference.

Figure 7:
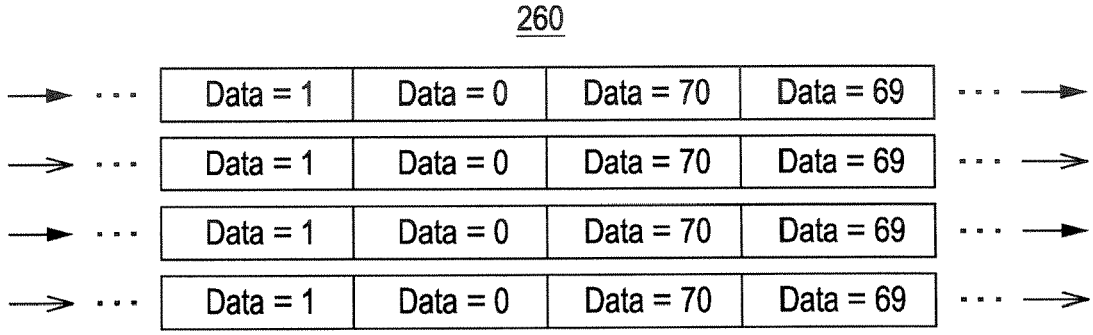
FIG. 7 is an explanatory diagram illustrating the physical sectors and data thereof in a reference signal recording region.

FIG. 7 is an explanatory diagram illustrating the physical sectors and data thereof in the reference signal recording region 260. One rectangular region is equivalent to one physical sector, and the value shown in the physical sector means the value of data provided to the physical sector.

As described above, in the event of providing 71 physical sectors on the same circumference, in order to identify each physical sector, data 0 through data 70 can be provided to each physical sector such that the value of data decreases in the order by which each physical sector is played. According to such a configuration, setting a point of time when playback of the physical sector of the data 0 is completed to the reference position of the optical disc 200 enables the absolute rotation angle of the optical disc 200 to be detected. Note that the contents of the data of each physical sector usually include error correction data, omitted here.

Also, as shown in FIGS. 5A and 5B, providing the multiple reference signals in a concentric circular shape enables the reference position and absolute rotation angle of the optical disc 200 to be detected based on another reference signal even in a state in which one reference signal fails to be played due to a scratch, stain or the like.

Next, description will be made regarding the signal processing unit 300 for processing such a reference signal.

Figure 8:
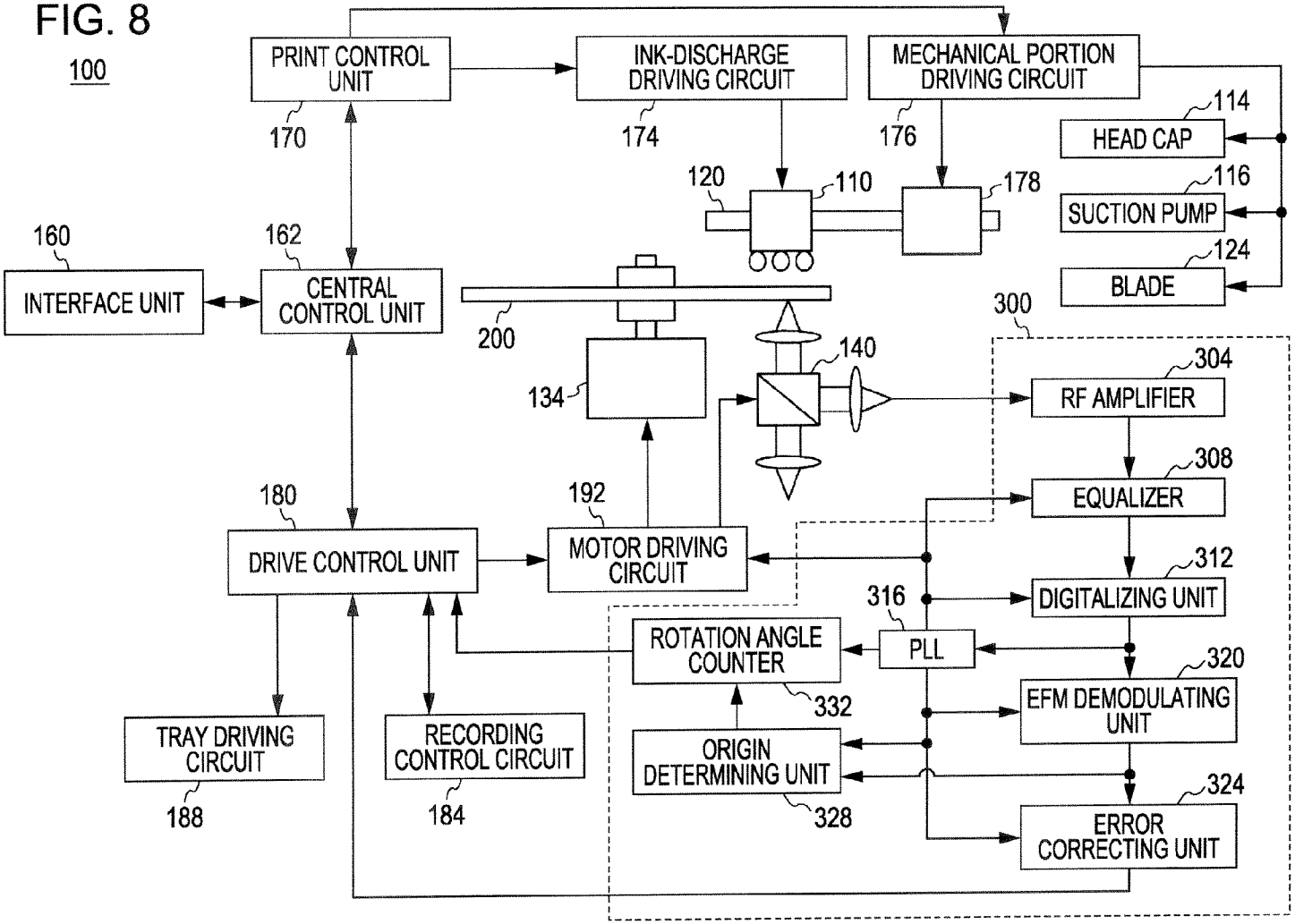
FIG. 8 is a block diagram illustrating the detailed configuration of a signal processing unit of the optical disc device according to the present embodiment.

FIG. 8 is a block diagram illustrating the detailed configuration of the signal processing unit 300 of the optical disc device 100 according to the present embodiment. The signal processing unit 300 includes an RF amplifier 304, an equalizer 308, a digitalizing unit 312, a PLL 316, an EFM demodulating unit 320, an error correcting unit 324, an origin determining unit 328, and a rotation angle counter 332.

The RF amplifier 304 amplifies a high-frequency signal input from the optical pickup 140 to output this to the equalizer 308. Further in detail, a reference signal is read out by the optical pickup 140 as strength of an electric current, and the RF amplifier 304 amplifies the strength of the electric current thereof by current-to-voltage conversion to output the high-frequency signal.

The equalizer 308, of the high-frequency signals input from the RF amplifier 304, enhances the high-frequency components deteriorated by the readout properties of the signal of the optical pickup 140.

The digitalizing unit 312 quantizes the high-frequency signal input from the equalizer 308 to either "1" or "0". As for the digitalizing unit 312, a comparator can be employed.

The PLL 316 generates a playback clock from the high-frequency signal input from the digitalizing unit 312. Also, the PLL 316 outputs the generated playback clock to the motor driving circuit 192, RF amplifier 304, equalizer 308, digitalizing unit 312, EFM demodulating unit 320, error correcting unit 324, origin determining unit 328, and rotation angle counter 332.

The EFM demodulating unit 320 demodulates the EFM (Eight to Fourteen Modulation)-modulated high-frequency signal input from the digitalizing unit 312 to output this to the error correcting unit 324 as a playback signal.

The error correcting unit 324 detects the error of the playback signal input from the EFM demodulating unit 320, and in the event that there is an error, corrects this to output the error-free playback signal.

The origin determining unit 328 determines the position where playback of the physical sector of the data 0 of the optical disc 200 is completed as the origin position, and outputs an origin detection signal to the rotation angle counter 328. Note that a method for determining the origin position is not restricted to this, so an arrangement may be made wherein a blank region is provided on a part of the reference signal recording region 260, and the position where the blank region is detected is set to the origin position.

The rotation angle counter 332 counts the playback clock input from the PLL 316, and upon the origin detection signal being input from the origin determining unit 328, resets the counter. The playback clock is information generated in increments of around 133 nm on the circumference of the disc in a DVD-R format, so the rotation angle counter 332 can detect the rotation angle of the optical disc 200 in increments of angle equivalent to around 133 nm on the circumference. That is to say, the rotation angle counter 332 can detect the position on the circumference of the reference signal recording region 260 with the resolution of 191,000 dpi.

Also, the above RF amplifier 304, equalizer 308, digitalizing unit 312, PLL 316, EFM demodulating unit 320, and error correcting unit 324 are arranged to be included in the existing signal processing unit 300, so the origin determining unit 328 and rotation angle counter 332 are added to this circuit, whereby detection of the rotation angle of the optical disc 200 can be realized.

Next, description will be made regarding the operation of the optical disc device 100 described above.

Figure 9:
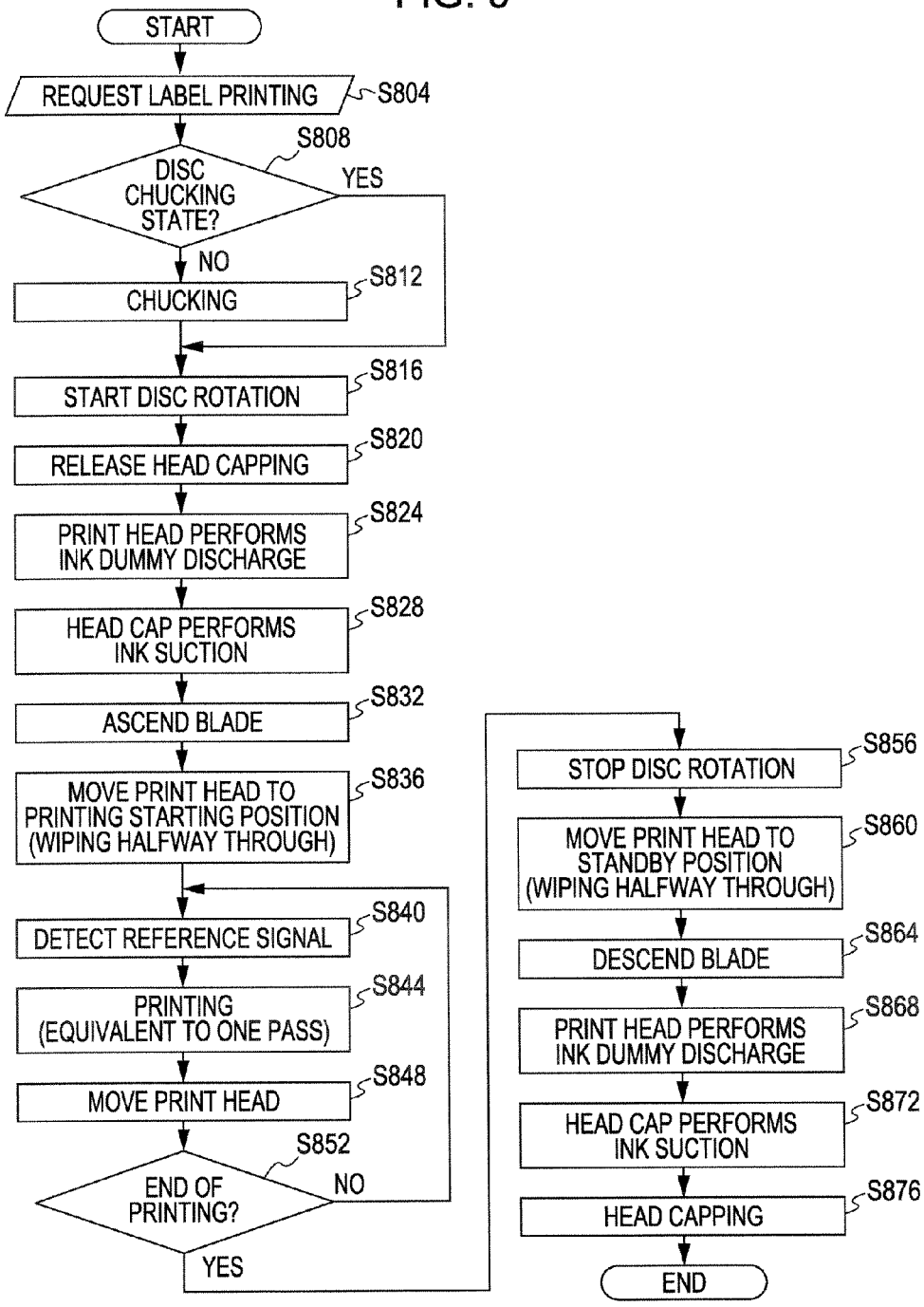
FIG. 9 is a flowchart illustrating the flow of the operation of the optical disc device according to the present embodiment.

FIG. 9 is a flowchart illustrating the flow of the operation of the optical disc device 100 according to the present embodiment.

First, upon printing of label information being requested of the optical disc device 100, determination is made regarding whether or not the optical disc 200 is subjected to chucking (S804, S808). In the event of determining that the optical disc 200 is not subjected to chucking, the chucking unit 138 subjects the optical disc 200 to chucking (S812).

In the event that determination is made in S808 that the optical disc 200 is subjected to chucking, or following the optical disc 200 being subjected to chucking in S812, the spindle motor 134 starts rotating of the optical disc 200 (S816). Subsequently, the inside of the head cap 114 mounted on the print head 110 is made into atmospheric pressure (S820), and the print head 110 performs dummy discharge of ink (S824). Next, the suction pump 116 absorbs the ink dummy-discharged by the print head 110 of the head cap 114 (S828), and moves the blade 124 to the position where the nozzle surface of the print head 110 can be wiped (S832).

Subsequently, the print head 110 is moved to the printing start position, and during this movement the nozzle surface 150 of the print head 110 is wiped by the blade 124 (S836). Subsequently, upon the origin position of the optical disc 200 being detected by the optical pickup 140, the print head 110 prints only a part of label information equivalent to one rotation (S840). Subsequently, the print head 110 is moved in the radial direction of the optical disc 200 as necessary (S848). Here, determination is made regarding whether or not the printing of the label information is completed (S852), and in the event of determining that the printing of the label information is completed, rotating of the optical disc 200 is stopped (S856). In the event of determining that the printing of the label information is not completed, the flow returns to S840 to continue the printing of the label information.

Next, the print head 110 is moved to the printing standby position, and during this movement the nozzle surface 150 of the print head 110 is wiped by the blade 124 (S860). Subsequently, the blade 124 is moved to the standby position (S864), and the print head 110 performs dummy discharge of ink (S868). Next, the suction pump 116 absorbs the ink dummy-discharged by the print head 110 of the head cap 114 (S872), and the head cap 114 is mounted on the nozzle surface 150 of the print head 110 (S876).

Note that the format of label information to be printed by such an optical disc device 100 can be set without any restriction.

Figure 10A:
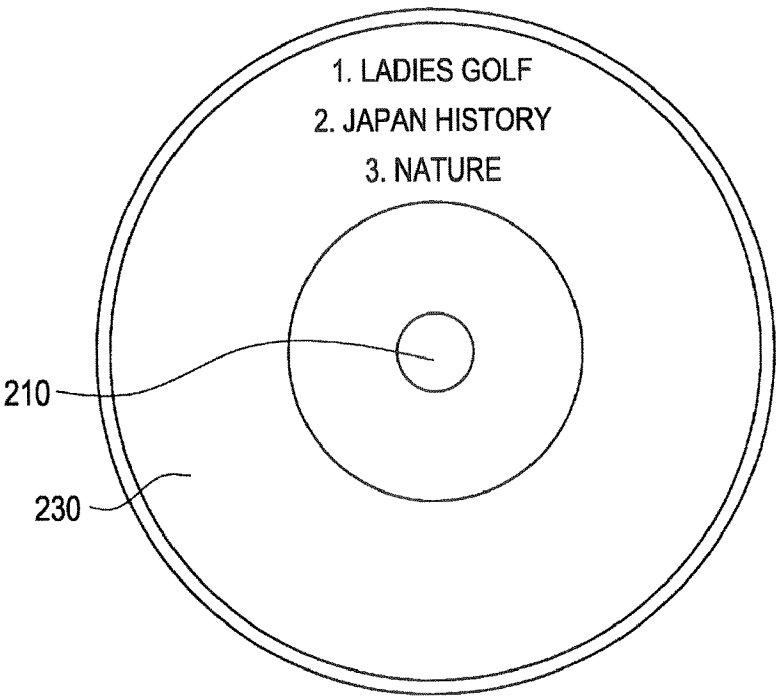
FIGS. 10A and 10B are explanatory diagrams illustrating examples of label information printed on the label surface of the optical disc.
Figure 10B:
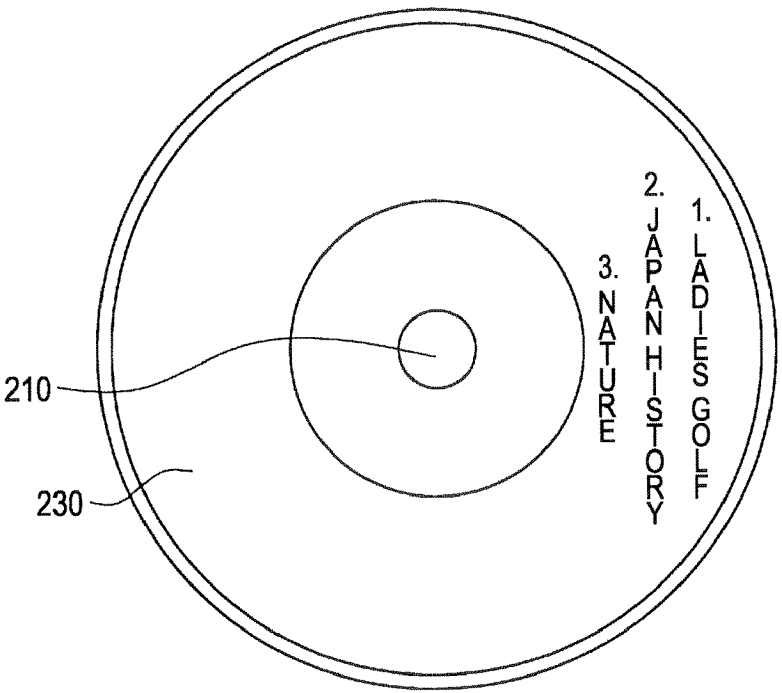

FIGS. 10A and 10B are explanatory diagrams illustrating examples of label information printed on the label surface of the optical disc 200. The label information can include a program name, broadcasting date, and a title, and also can include an image such as a photo or picture indicating the contents of a program.

FIG. 10A illustrates an example wherein label information is horizontally written on the label surface of the optical disc 200, and FIG. 10B illustrates an example wherein label information is vertically written on the label surface of the optical disc 200. However, the printing format is not restricted to these, and various types of formats, such as printing in the circumferential direction, in a spiral shape, and so forth, can be employed. Also, the items, character size, character fonts, and the like, of label information to be printed, can be selected as appropriate.

Also, with the above optical disc device 100, an example has been described wherein the optical disc 200 serving as a recording medium itself is rotated by the spindle motor 134, but a driver for performing driving as to a recording medium is a concept including a driver for driving at least one of a recording medium and the printing unit to cause speed difference between the recording medium and the printing unit, and a driver for driving at least one of a recording medium and the recording and/or playback unit to cause speed difference between the recording medium and the printing unit. Note that movement due to driving of the driver is not restricted to rotational movement, and may be linear movement for example.

Accordingly, in the event of operating a recording medium, the printing unit, and recording and/or playback unit with a driver, the "driving speed of the driver" means, in the printing mode, "the relative speed of a recording medium with the above printing unit as reference", and in the recording or playback mode means "the relative speed of a recording medium with the above recording and/or playback unit as reference".

Also, as described with the present embodiment, in the event of driving a recording medium itself, the driver for performing driving as to the recording medium means a driver for driving the recording medium. The rotation speed, movement speed, or the like of a recording medium is equivalent to driving speed.

Second Embodiment

Next, description will be made regarding an optical disc device 100 according to a second embodiment of the present invention.

Figure 11:
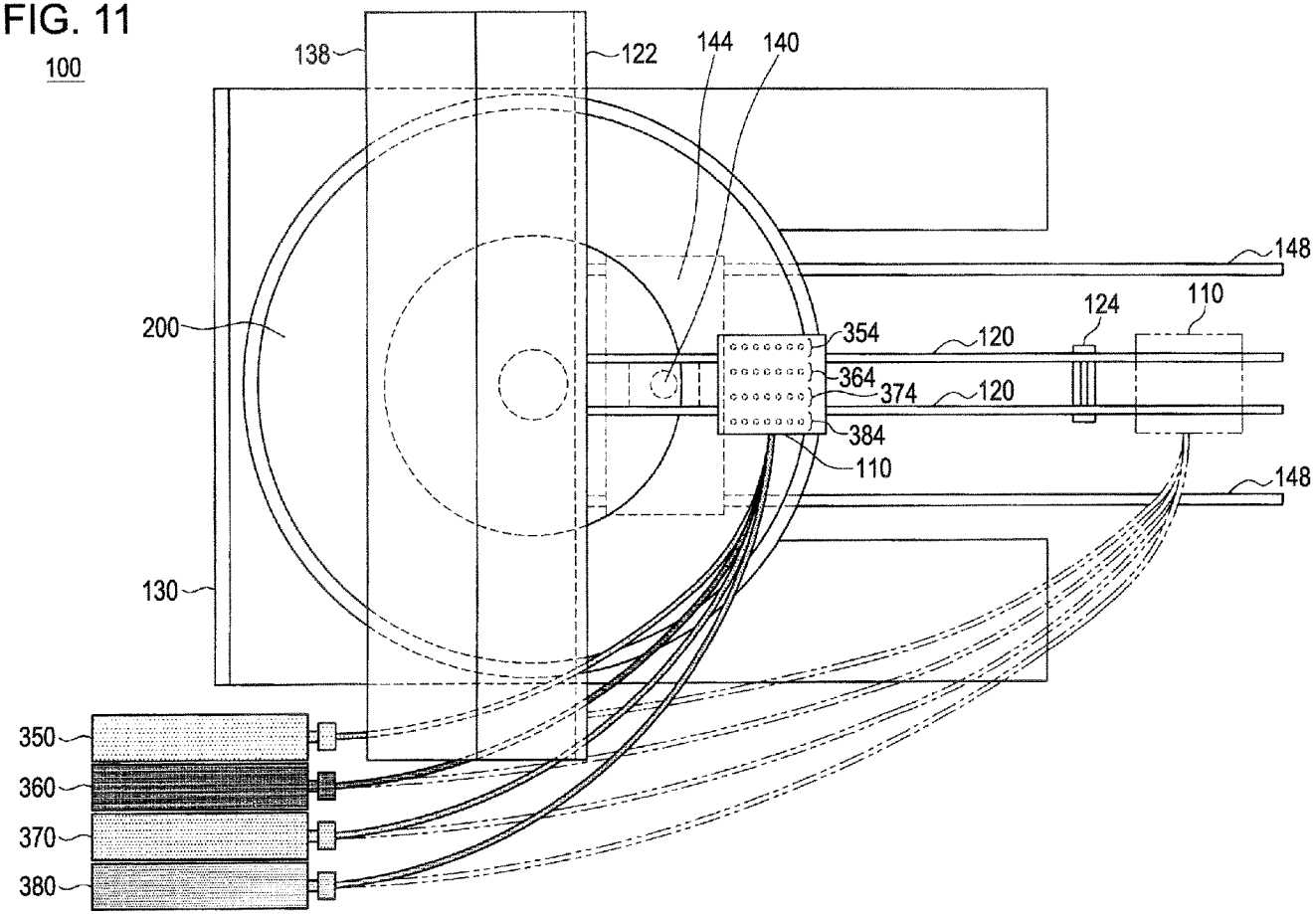
FIG. 11 is a plan view of an optical disc device according to a second embodiment of the present invention.

FIG. 11 is a plan view of an optical disc device 100 according to the second embodiment of the present invention. The optical disc device 100 includes a print head 110, a blade 120, a first guide shaft 122, a shaft supporting portion 124, a tray 130, a chucking unit 138, an optical pickup 140, a movable carriage 144, and ink cartridges 350 through 380. The configurations and operations of the blade 120, first guide shaft 122, shaft supporting portion 124, tray 130, chucking unit 138, optical pickup 140, and movable carriage 144 are substantively the same as those in the first embodiment, so description thereof will be omitted here.

The ink cartridge 350 includes yellow color ink, ink cartridge 360 includes cyan color ink, ink cartridge 370 includes magenta color ink, and ink cartridge 380 includes black color ink. Also, the print head 110 includes multiple nozzle lines 354 through 384. According to such a configuration, the optical disc device 100 can print label information on the label surface of an optical disc 200 in full color.

On the other hand, the multiple nozzle lines are included in the print head 110 of the optical disc device 100, so it is difficult to match the array directions of all the nozzle lines 354 through 384 with the radial direction of the optical disc 200. Therefore, even if ink is discharged from each of the innermost nozzles of the nozzle lines 354 through 384 for example, there have been cases of irregularities in where ink lands, in the radial direction of the optical disc 200.

That is to say, the nozzle lines 354 and 384 have a relation of line symmetry centered on the straight line extending in the predetermined radial direction of the optical disc 200, so both the radial distances where ink lands are identical. This can be applied to the nozzle lines 364 and 374. However, between the nozzle lines 354 and 364, between the nozzle lines 374 and 384, and so forth do not have such a relation of line symmetry, which has caused a problem by creating irregularities in the radial distances where ink lands.

Therefore, with the optical disc device 100 according to the present embodiment, nozzle and ink discharge timing for printing each of dots of label information can be determined with a calculation such as optimizing the landing position of ink. According to such a calculation, the irregularities in the radial distances where ink lands can be reduced to one dot or less (the interval of each ink making up a printing image), whereby label information can be printed with high quality. Particularly, if we can set printing resolution to 300 dpi or more, such a problem can be almost eliminated.

Third Embodiment

Next, description will be made regarding a recording/playback device 400 including an optical disc device 100 according to a third embodiment of the present invention.

The recording/playback device 400 includes a function for playing video or audio based on a broadcasting signal externally received, and recording the video or audio in a built-in HDD 472. Also, employing the optical disc device 100 enables a data signal such as video, audio, or the like to be recorded in the optical disc 200, enables a data signal to be read from the optical disc 200, and enables video, audio, or the like to be played. Description will be made below regarding the details of such a recording/playback device 400.

Figure 12:
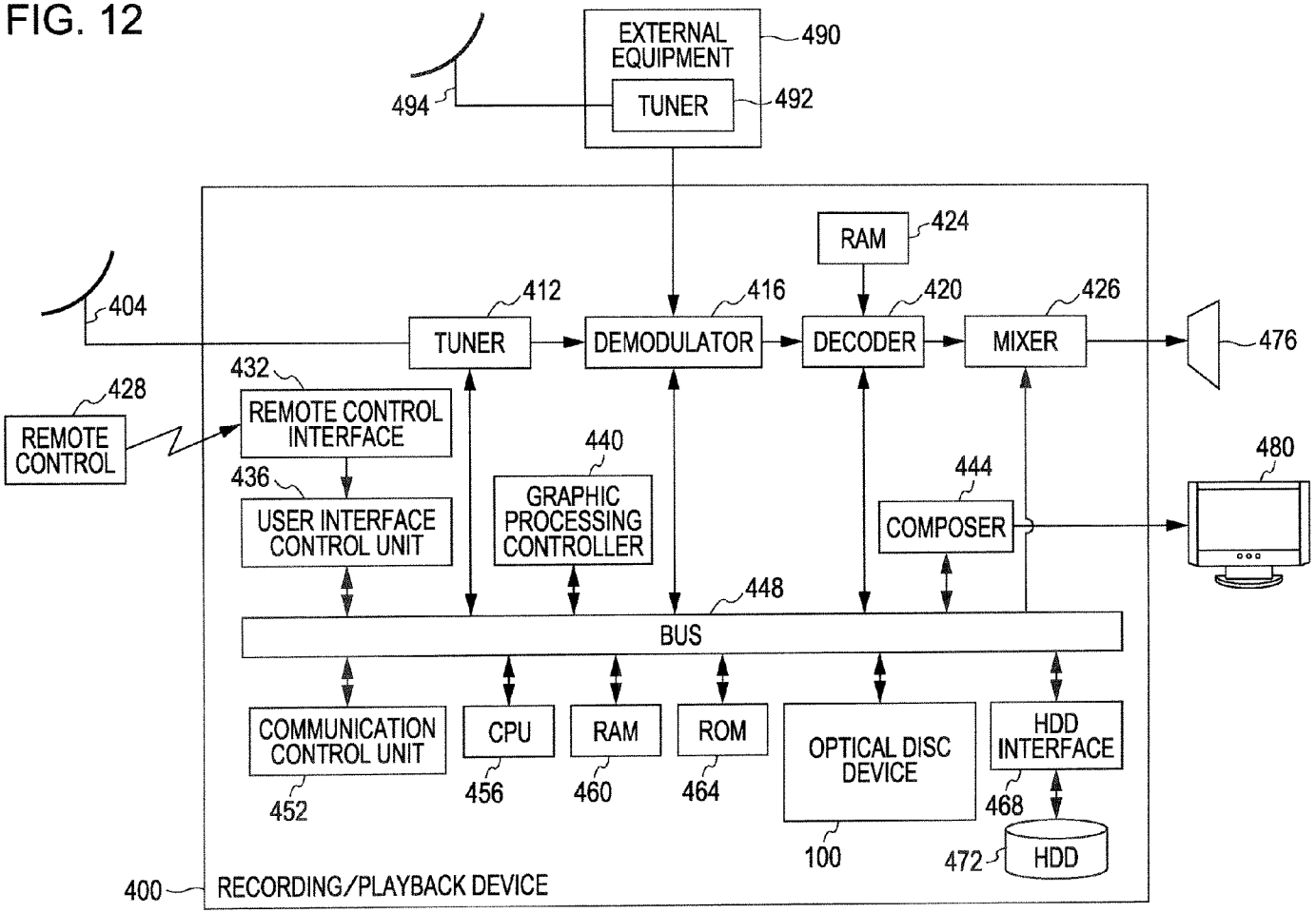
FIG. 12 is a block diagram illustrating the configuration of a recording/playback device according to a third embodiment of the present invention.

FIG. 12 is a block diagram illustrating the configuration of the recording/playback device 400. The recording/playback device 400 includes an optical disc device 100, an antenna 404, a tuner 412, a demodulator 416, a decoder 420, RAM 424, a mixer 426, a remote control 428, a remote control interface 432, a user interface control unit 436, a graphic processing controller 440, a composer 444, a bus 448, a communication control unit 452, a CPU 450, RAM 460, ROM 464, an HDD interface 468, and an HDD 472, and is connected to speakers 476, a display 480, and an external device 490.

The antenna 404 receives broadcast waves sent from a satellite, television station, or the like. The antenna 404 can be configured of a parabola antenna so as to receive a broadcasting signal having directivity.

The tuner 412 selects a predetermined channel broadcasting signal based on the control of the CPU from multiple channel broadcasting signals included in the broadcast waves received at the antenna 404, and outputs the selected broadcasting signal to the demodulator 416. The broadcasting signal is superimposed with later-described electronic program data besides a video signal or audio signal.

In the event that the broadcasting signal input from the tuner 412 is a digital format, the demodulator 416 converts this into an analog format, and outputs this to the decoder 420. The decoder 420 decodes the broadcasting signal input from the demodulator 416, outputs an audio signal to the mixer 426, and outputs a video signal to the composer 444. The RAM 424 is a work area that is employed when the decoder 420 subjects a broadcasting signal to decoding processing.

The mixer 426 performs adjustment of the amplitude for each frequency band and the entire balance of the audio signal input from the decoder and the optical disc device 100 via the bus 448, and outputs this to the speakers 476. The speakers 476 convert the audio signal input from the mixer 426 into audio, and output this.

The remote control 428 detects various types of operation relating to the recording/playback device 400 by the user, and emits light as an infrared signal at the recording/playback device 400. The remote control interface 432 receives the infrared signal, and the user interface control unit 436 converts the infrared signal into an electric signal to output this to the CPU 456.

The graphic processing controller 440 creates an electronic program list based on electronic program data superimposed on a broadcasting signal, and generates a GUI (Graphical User Interface) display screen.

The composer 444 outputs a combination of the video signal input from the optical disc device 100, HDD 468, decoder 420, or the like, and the display screen generated by the graphic processing controller 440, or one of these to the display 480. The display 480 displays the video based on the input from the composer 444.

The communication control unit 452 controls the overall communication between the recording/playback device 400 and the external device. The CPU 456 controls the entire operation of the recording/playback device 400, and the RAM 460 is the work area of the CPU 456. The ROM 464 stores a program to be read in at the time of activating the recording/playback device 400.

The HDD interface 468 performs exchange of a data signal as to the HDD 472. A data signal such as a video signal, audio signal, or the like is stored in the HDD 472.

The external device 490 includes the tuner 492 and the antenna 494, can receive broadcast waves at the antenna 494, and select a predetermined broadcasting signal from the broadcast waves to output this to the recording/playback device 400.

The optical disc device 100, as described with the above embodiment, can record a data signal on the recording surface, and print label information on the label surface of the optical disc 200. Description will be made below regarding the optical disc device 100 operating in corroboration with the recording/playback device 400.

The label information to be printed on the label surface of the optical disc 200 can be generated by the user operating the remote control 428 to input a desired character string, symbol, and so forth to the recording/playback device 400. However, it is troublesome for the user to input the program name and broadcasting date and the like of a television program each time whenever the user attempts to print label information. Therefore, the optical disc device 100 according to the present embodiment is configured so as to create label information using electronic program data, whereby the time and effort of the user can be reduced.

FIG. 13 is an explanatory diagram illustrating the contents of the electronic program data. The electronic program data includes, for example, a program name, a channel, a broadcasting date, a main genre, a sub genre, a performer, and so forth. Creating label information using such electronic program data enables the user to omit time and effort for inputting a program name, a broadcasting date, and so forth from the beginning, whereby label information can be printed easily.

Note that in the event of storing television program data in the HDD 472, the CPU 456 performs this by correlating the data of video and audio with the electronic program data of the television program. According to such a configuration, regardless of the case of printing label information on the optical disc 200 in real time, even following television program data is stored in the HDD 472, label information can be created based on the electronic program data.

Also, in the event that only a data signal is recorded in the optical disc 200 in real time, and label information is not printed thereupon, the label information may be recorded on a predetermined recording surface of the HDD 472 or the optical disc 200. According to such a configuration, in the event that the label information that was determined to be unnecessary, and was not printed, becomes necessary later, the label information thereof can be readily printed on the optical disc 200.

Further, the label information printed on the optical disc 200 may be stored in the HDD 472. Further in detail, the optical disc 200 includes a unique serial number, whereby the optical disc 200 can be identified by the serial number thereof. Accordingly, the label information printed on the optical disc 200, and the serial number of the optical disc 200 thereof can be stored by correlating therebetween.

According to such a configuration, label information can be further printed (additional printing) on an unprinted area of the optical disc 200 on which label information has been already printed. That is to say, the control unit such as the central control unit 162 or the CPU 456 or the like searches the serial number of the optical disc 200 stored in the HDD 472, and extracts the label information that was correlated with the serial number, and was printed. Subsequently, the unprinted area on the label surface of the optical disc 200 is estimated based on the printed label information, and new label information is created within a range of the unprinted area. Accordingly, the optical disc device 100 can print the new label information thereof without being overlapped with the printed label information.

The label information printed on the optical disc 200 can be recorded on a predetermined area on the recording surface of the optical disc 200. According to such a configuration, even with a recording/playback device which is different from the recording/playback device employed at the time of printing label information in the past, additional printing of label information can be performed.

Next, description will be made regarding the flow of the operation of the recording/playback device 400.

Figure 14:
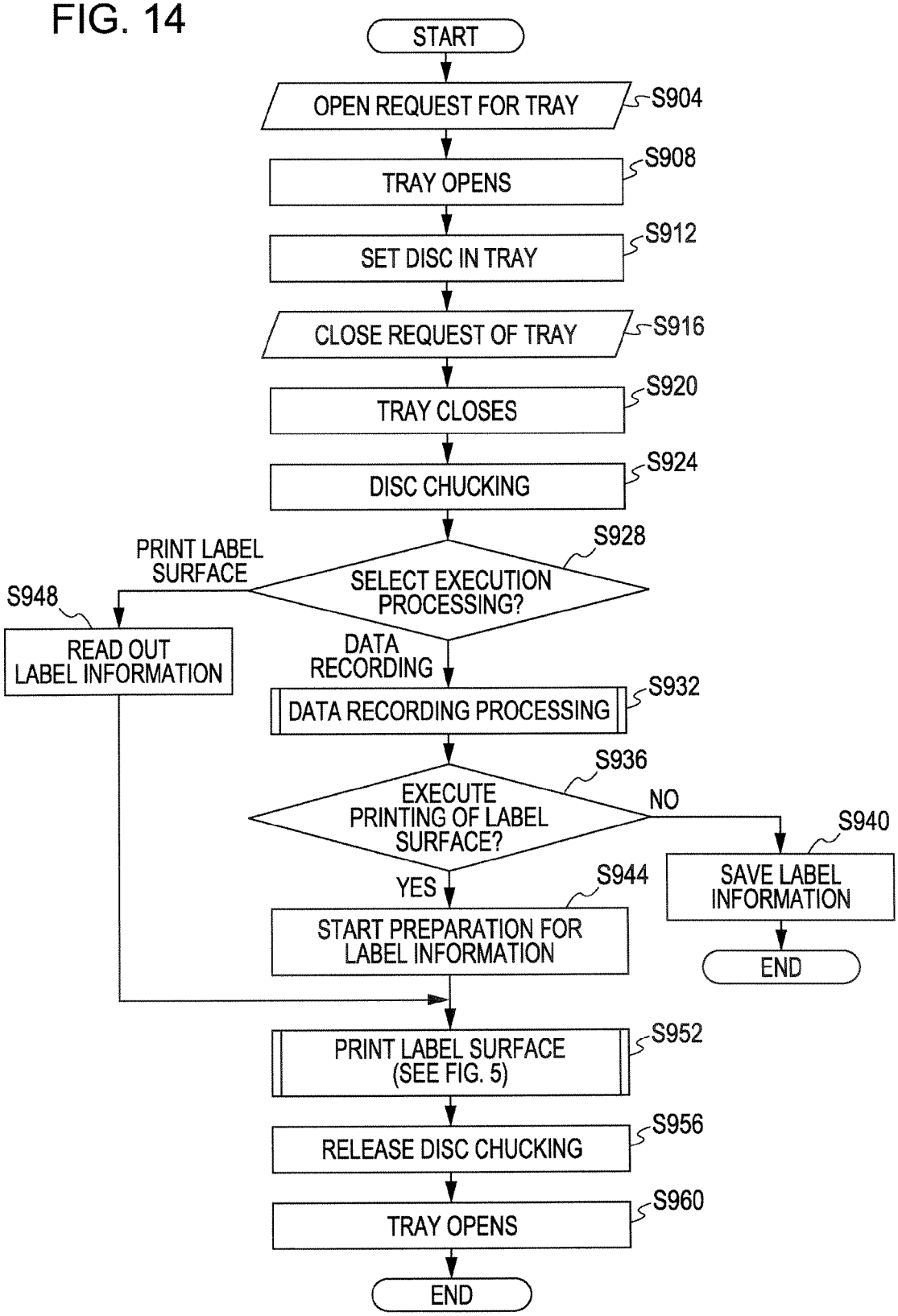
FIG. 14 is a flowchart illustrating the flow of the operation of the recording/playback device.

FIG. 14 is a flowchart illustrating the flow of the operation of the recording/playback device 400. The recording/playback device 400, upon detecting an open request of the tray 130, first opens the tray 130 (S904, S908). Subsequently, upon the optical disc 200 being set in the tray 130, and a close request of the tray 130 being detected, the recording/playback device 400 closes the tray 130 (S912, S916, S920). Subsequently, the chucking unit 138 subjects the optical disc 200 to chucking (S924).

Next, the recording/playback device 400 determines regarding whether recording of a data signal or printing of label information is performed (S928). In the event of determining that data recording processing is performed, the recording/playback device 400 records a data signal on the optical disc 200 (S932). Note that recording processing of a data signal on the optical disc 200 is performed in accordance with a recording method such as CD-R/RW, recordable DVD (DVD-R/RW/+R/+RW/RAM and so forth), recordable blue-ray disc (BD-R/BD-RE) or the like.

Subsequently, the recording/playback device 400 determines regarding whether or not label information is printed on the label surface (S936). In the event of determining that the label information is not printed, the recording/playback device 400 stores the label information in a predetermined area of the recording surface of the optical disc 200 or the HDD 472, and ends the processing (S940). In the event of determining that the label information is printed, the recording/playback device 400 creates the label information (S944). Subsequently, the recording/playback device 400 executes the printing processing of label information described with the first embodiment (S952).

In the event of determining that the label information is printed in S928, the recording/playback device 400 reads out the label information stored in a predetermined area of the recording surface of the optical disc 200, the HDD 472, or the like (S948), and executes the printing processing of the label information described with the first embodiment (S952). Note here that a situation is assumed wherein, on the optical disc 200 on which data signals have been recorded, label information showing the contents of the data signals is printed later.

Upon the printing processing of the label information ending, the recording/playback device 400 releases the chucking by the chucking unit 138 of the optical disc 200 (S956). Finally, the recording/playback device 400 opens the tray 130 so as to have the optical disc 200 taken out (S960), and ends the operation.

Description has been made so far regarding the preferable embodiments of the present invention with reference to the appended drawings, but it is needless to say that the present invention is not restricted to such examples. It will be clear to one skilled in the art that various kinds of modifications, combinations, sub-combinations and alterations may be made, and that the present invention is not restricted to any such embodiments except as laid forth in the appended claims or the equivalents thereof. It will be further understood that such modifications, combinations, sub-combinations and alterations belong to the technical scope of the present invention.

For example, printing of label information on the optical disc 200 may be performed before or after recording of a data signal. Also, it is not always necessary to process the respective steps in the printing processing of label information of the present specification, and the recording/playback device in time series in accordance with the sequence described as the flowchart, and processing executed in parallel or individually (e.g., parallel processing or processing by an object) may be encompassed in the present invention.

What is claimed is:

1. A recording medium driving device for driving a recording medium, comprising:

a recording and/or playback unit for performing at least one of recording of a data signal on a recoding surface of said recording medium, and playback of a data signal from said recording surface;

a printing unit for printing visible information on a main surface different from said recording surface of said recording medium using an inkjet method;

a driver for performing driving as to said recording medium; and a drive control unit for switching a driving speed of said driver between (1) a first driving speed for a printing mode for printing visible information on said main surface, the first driving speed being less than 1.4 m/s at an outermost circumference of the recording medium, and (2) a second driving speed for a recording/playback mode for recording or playback of said data signal on/from said recording surface, wherein said printing unit adjusts a number of times of ink discharge per unit time depending on the radius distance from the center of said recording medium of the printing position of said visible information.

2. The recording medium driving device according to claim 1, wherein the driving speed of said printing mode is slower than the driving speed of said recording/playback mode.

3. The recording medium driving device according to claim 1, wherein said printing unit adjusts a printing position based on positional information of said recording medium read out from a reference signal recorded on the recording surface of said recording medium.

4. The recording medium driving device according to claim 3, wherein said reference signal is recorded on a circumference in one or a plurality of predetermined radius distance of said recording medium.

5. A recording medium driving method employing a recording medium driving device for driving a recording medium, including a recording and/or playback unit for performing at least one of recording of a data signal on a recoding surface of said recording medium, and playback of a data signal from said recording surface, and a printing unit for printing visible information on a main surface different from said recording surface of said recording medium using an inkjet method, for printing said visible information, said method comprising:

switching a driving speed of a driver for driving said recording medium between (1) a first driving speed for a printing mode for printing visible information on said main surface, the first driving speed being less than 1.4 m/s at an outermost circumference of the recording medium, and (2) a second driving speed for a recording/playback mode for recording or playback of said data signal on/from said recording surface; and said printing unit adjusting a number of times of ink discharge per unit time depending on the radius distance from the center of said recording medium of the printing position of said visible information.

6. The recording medium driving method according to claim 5, wherein the driving speed of said printing mode is slower than the driving speed of said recording/playback mode.

7. The recording medium driving method according to claim 5, further comprising said printing unit adjusting a printing position based on positional information of said recording medium read out from a reference signal recorded on the recording surface of said recording medium.

8. The recording medium driving method according to claim 7, wherein said reference signal is recorded on a circumference in one or a plurality of predetermined radius distance of said recording medium.

9. A recording medium driving device for driving a recording medium, comprising:

a recording and/or playback unit for performing at least one of recording of a data signal on a recoding surface of said recording medium, and playback of a data signal from said recording surface;

a printing unit for printing visible information on a main surface different from said recording surface of said recording medium using an inkjet method;

a driver for performing driving as to said recording medium; and a drive control unit for switching a driving speed of said driver between (1) a first driving speed for a printing mode for printing visible information on said main surface and (2) a second driving speed for a recording/playback mode for recording or playback of said data signal on/from said recording surface, wherein said printing unit adjusts a number of times of ink discharge per unit time depending on the radius distance from the center of said recording medium of the printing position of said visible information.

10. The recording medium driving device according to claim 9, wherein the driving speed of said printing mode is slower than the driving speed of said recording/playback mode.

11. The recording medium driving device according to claim 9, wherein said printing unit adjusts a printing position based on positional information of said recording medium read out from a reference signal recorded on the recording surface of said recording medium.

12. The recording medium driving device according to claim 11, wherein said reference signal is recorded on a circumference in one or a plurality of predetermined radius distance of said recording medium.

* * * * *